US009813817B2

(12) United States Patent
Lee et al.

(10) Patent No.: US 9,813,817 B2
(45) Date of Patent: Nov. 7, 2017

(54) VIBRATING DIAPHRAGM STRUCTURE AND METHOD OF MANUFACTURE THEREOF

(71) Applicant: Cheng Uei Precision Industry Co., Ltd., New Taipei (TW)

(72) Inventors: James Lee, New Taipei (TW); Yi Lin Yang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 15/489,779

(22) Filed: Apr. 18, 2017

(65) Prior Publication Data

US 2017/0289691 A1 Oct. 5, 2017

Related U.S. Application Data

(62) Division of application No. 15/083,291, filed on Mar. 29, 2016.

(51) Int. Cl.
*H04R 7/06* (2006.01)
*H04R 31/00* (2006.01)

(52) U.S. Cl.
CPC ..... *H04R 7/06* (2013.01); *H04R 31/003* (2013.01); *H04R 2307/023* (2013.01); *H04R 2307/204* (2013.01); *H04R 2307/207* (2013.01)

(58) Field of Classification Search
CPC .. H04R 7/06; H04R 31/003; H04R 2307/023; H04R 2307/204; H04R 2307/207
USPC ..... 181/164, 165, 171, 172; 381/424, 426
See application file for complete search history.

(56) References Cited

U.S. PATENT DOCUMENTS

| | | | | |
|---|---|---|---|---|
| 3,846,650 | A * | 11/1974 | Barrow | H04R 7/26 310/312 |
| 6,183,674 | B1 * | 2/2001 | Nonogaki | B29C 44/569 264/138 |
| 6,453,050 | B1 * | 9/2002 | Ogura | H04R 17/00 381/182 |
| 6,862,361 | B2 * | 3/2005 | James | H04R 7/20 181/171 |
| 7,980,355 | B2 * | 7/2011 | Tokura | H04R 7/24 181/171 |
| 2003/0188919 | A1 * | 10/2003 | Suzuki | H04R 7/20 181/171 |
| 2006/0008111 | A1 * | 1/2006 | Nagaoka | H04R 7/122 381/423 |
| 2006/0147081 | A1 * | 7/2006 | Mango, III | H04R 7/125 381/398 |
| 2011/0026758 | A1 * | 2/2011 | Wang | H04R 7/14 381/398 |
| 2011/0075881 | A1 * | 3/2011 | Wang | H04R 7/00 381/423 |

(Continued)

*Primary Examiner* — Jeremy Luks
(74) *Attorney, Agent, or Firm* — Lin & Associates Intellectual Property, Inc.

(57) ABSTRACT

A vibrating diaphragm includes a diaphragm body and a suspension edge. The diaphragm body is made by acrylonitrile butadiene styrene materials. A surface of the diaphragm body is electroplated a layer of nanoscale materials. The suspension edge is made by room temperature vulcanized silicone rubber materials. The suspension edge is molded an outer periphery of the diaphragm body. The vibrating diaphragm can improve the high frequency effect of the speaker.

1 Claim, 5 Drawing Sheets

(56) References Cited

U.S. PATENT DOCUMENTS

| | | | | |
|---|---|---|---|---|
| 2011/0228949 | A1* | 9/2011 | Haba | H04R 1/028 381/86 |
| 2015/0136518 | A1* | 5/2015 | Lin | H04R 31/003 181/157 |
| 2015/0319539 | A1* | 11/2015 | Wei | H04R 23/002 381/164 |
| 2016/0057544 | A1* | 2/2016 | Chamarthy | H04R 9/046 381/410 |

* cited by examiner

VIBRATING DIAPHRAGM STRUCTURE AND METHOD OF MANUFACTURE THEREOF

CROSS REFERENCE TO RELATED APPLICATIONS

This application is a Divisional of co-pending U.S. patent application Ser. No. 15/083,291, filed on Mar. 29, 2016, which is incorporated herewith by reference.

BACKGROUND OF THE INVENTION

1. Field of the Invention

The present invention relates to a speaker, and more particularly to a vibrating diaphragm structure of the speaker and method of manufacture thereof.

2. The Related Art

A traditional vibrating diaphragm structure includes an annular-shaped suspension edge and a circular-shaped diaphragm body. The suspension edge is a plastic material and the diaphragm body is a paper material. The diaphragm body is stuck on the suspension edge by glue and seals a hollow part of the suspension edge. The centers of the diaphragm body and the suspension edge are the same.

However, when the diaphragm body is stuck on the suspension edge by an operator, a position deviation usually occurs to result in the centers of the diaphragm body and the suspension edge are not the same. Thus it greatly affects a distortion and a sound quality of the speaker. Also, the diaphragm body uses the paper material shows a poor performance in high frequency.

SUMMARY OF THE INVENTION

Accordingly, an object of the present invention is to provide a vibrating diaphragm mounted on a speaker. The vibrating diaphragm includes a diaphragm body and a suspension edge. The diaphragm body is made by acrylonitrile butadiene styrene materials. A surface of the diaphragm body is electroplated a layer of nanoscale materials. The suspension edge is made by room temperature vulcanized silicone rubber materials. The suspension edge is molded an outer periphery of the diaphragm body.

Accordingly, a manufacture method of the vibrating diaphragm: molding a circular-shaped diaphragm body using acrylonitrile butadiene styrene materials; electroplating a layer of nanoscale materials to the surface of the diaphragm body; placing the diaphragm body in a mould, and molding the room temperature vulcanization silicone rubber on the outer periphery of the diaphragm body to form an annular-shaped suspended edge, the inner periphery of the suspension edge having an annular-shaped slot, the outer periphery of the diaphragm body fixed in the slot of the suspension edge, and the centers of the diaphragm body and the suspension edge being the same.

As described above, the diaphragm body of the vibrating diaphragm is made by ABS materials, the surface of the diaphragm body is electroplated a layer of nanoscale materials, and the room temperature vulcanization silicone rubber is molded on the outer periphery of the diaphragm body to form the suspended edge to make sure the centers of the diaphragm body and the suspension edge are the same, which improves the high frequency effect of the speaker with the vibrating diaphragm.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
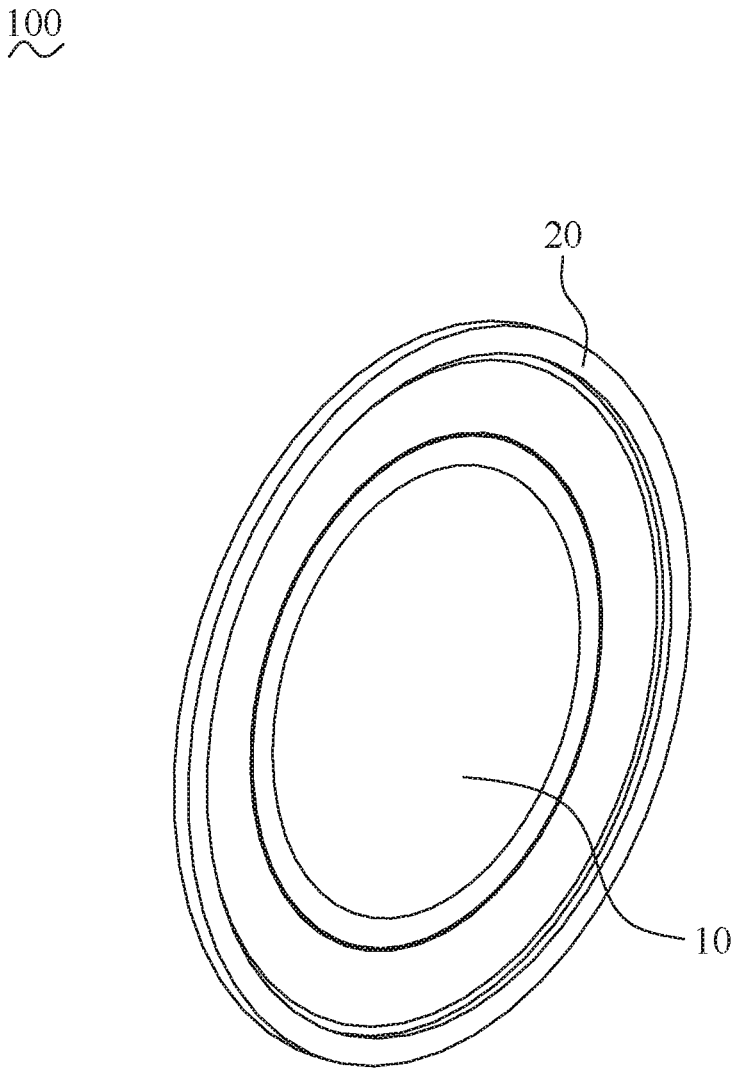
FIG. 1 is an assembled, perspective view of a vibrating diaphragm in accordance with an embodiment of the present invention.
Figure 2:
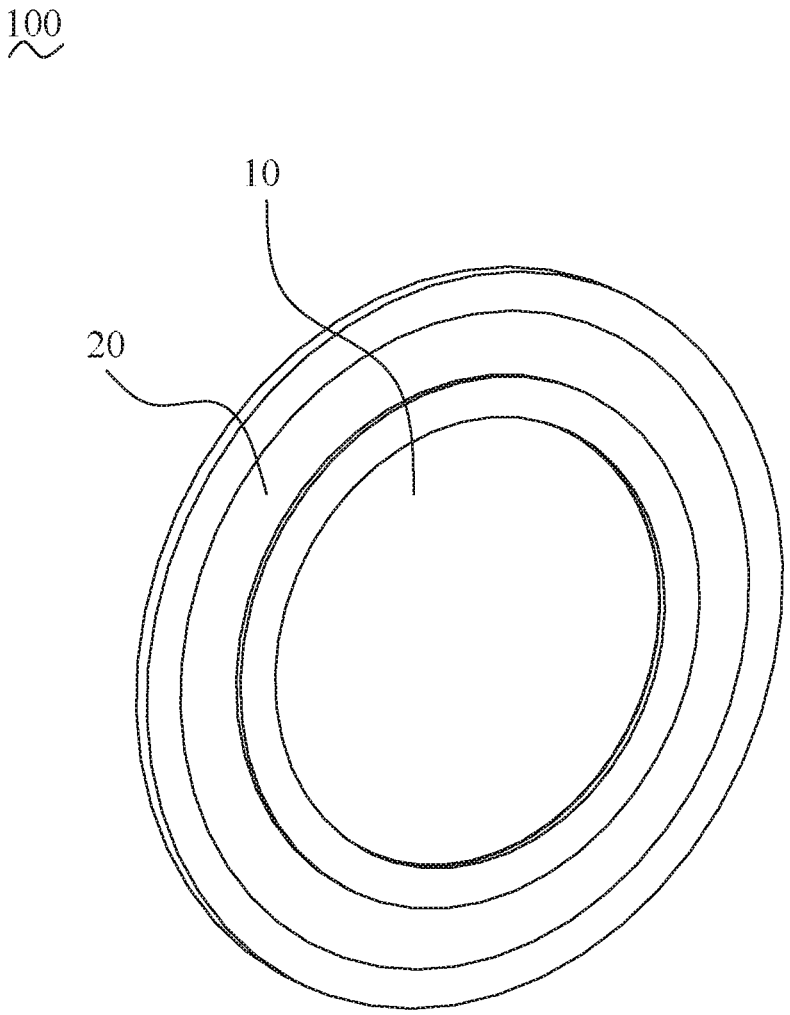
FIG. 2 is another angle assembled, perspective view of the vibrating diaphragm shown in FIG. 1.

Referring to the drawings in greater detail, and first to FIG. 1 and FIG. 2, an embodiment of the present invention is embodied in a vibrating diaphragm 100 mounted on a speaker (not shown). The vibrating diaphragm 100 includes a diaphragm body 10 and a suspension edge 20.

Figure 3:
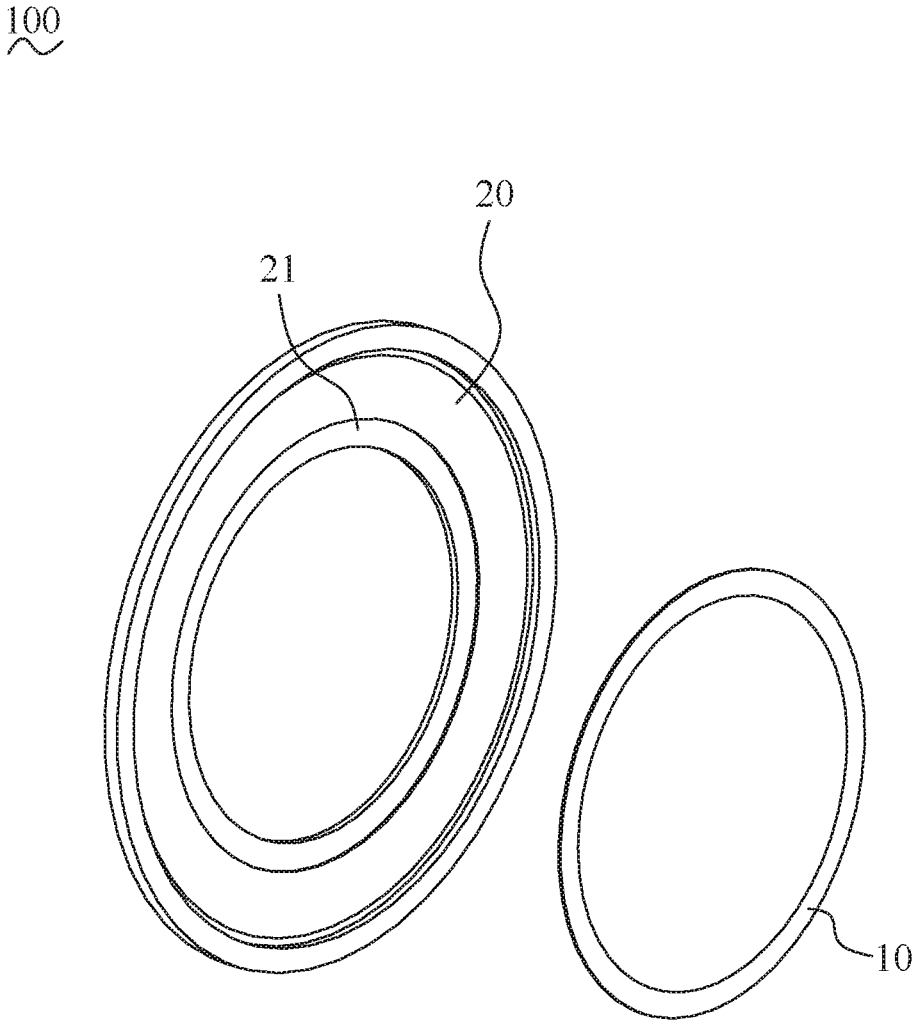
FIG. 3 is an exploded, perspective view of the vibrating diaphragm shown in FIG. 1.

Referring to FIG. 3, the diaphragm body 10 is a circular-shaped diaphragm body. The diaphragm body 10 is made by Acrylonitrile Butadiene Styrene (ABS) materials. A surface of the diaphragm body 10 is electroplated a layer of nanoscale materials.

The suspension edge 20 is an annular-shaped sheet. The suspension edge 20 is made by room temperature vulcanized silicone rubber materials. The suspension edge 20 is molded to an outer periphery of the diaphragm body 10. An inner periphery of the suspension edge 20 has an annular-shaped slot 21. An outer periphery of the diaphragm body 10 is fixed in the slot 21 of the suspension edge 20. The centers of the diaphragm body 10 and the suspension edge 20 are the same.

Specific steps of the manufacture method of the vibrating diaphragm 100 in accordance with the embodiment of the present invention are described as follows:

Step one: molding a circular-shaped diaphragm body 10 using acrylonitrile butadiene styrene materials;

Step two: electroplating a layer of nanoscale materials to the surface of the diaphragm body 10;

Step three: placing the diaphragm body in a mould, and molding the room temperature vulcanization silicone rubber on the outer periphery of the diaphragm body to form an annular-shaped suspended edge, the inner periphery of the suspension edge having an annular-shaped slot, the outer periphery of the diaphragm body fixed in the slot of the suspension edge, and the centers of the diaphragm body and the suspension edge being the same.

Figure 4:
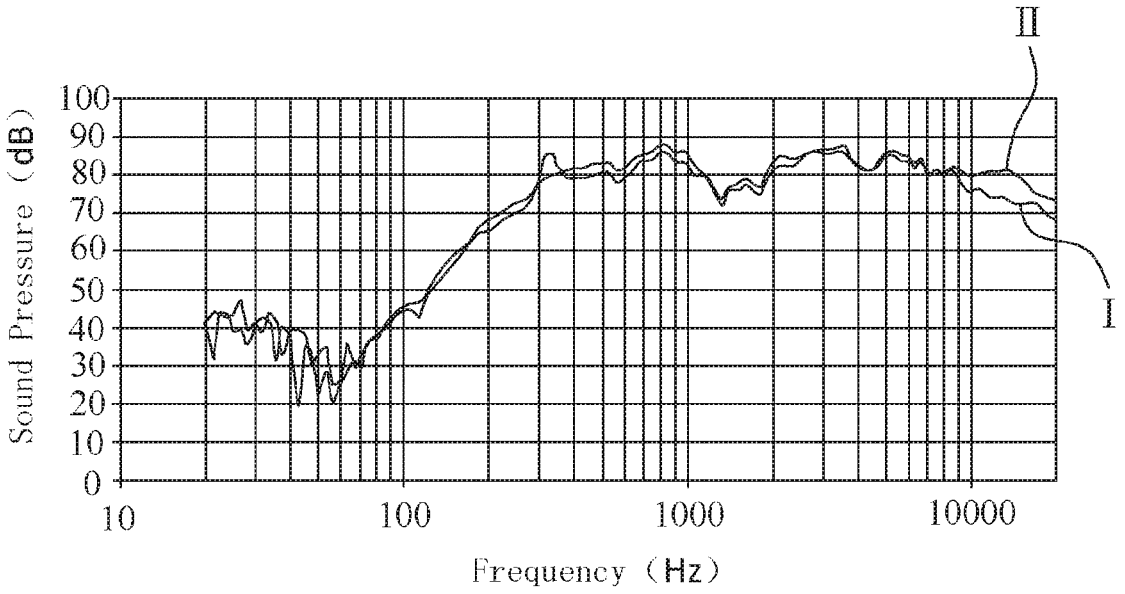
FIG. 4 is a diagram showing frequency response curves of a speaker with the vibrating diaphragm of FIG. 1 and another speaker with the vibrating diaphragm with paper material in the related art.

Referring to FIG. 4, which shows frequency response curves of the speaker with the vibrating diaphragm 100 and another speaker with the vibrating diaphragm with paper material in the related art, a curve I shows the frequency response of the speaker with the vibrating diaphragm with paper material and a curve II shows the frequency response of the speaker with the vibrating diaphragm 100. In low frequency, the sound pressure of the speaker with the vibrating diaphragm 100 and the speaker with the vibrating diaphragm with paper material have almost no difference, but in high frequency, the sound pressure of the speaker with the vibrating diaphragm 100 is improved 5 dB than the speaker with the vibrating diaphragm with paper material. Therefore, a high frequency effect of the speaker with the vibrating diaphragm 100 is improved.

Figure 5:
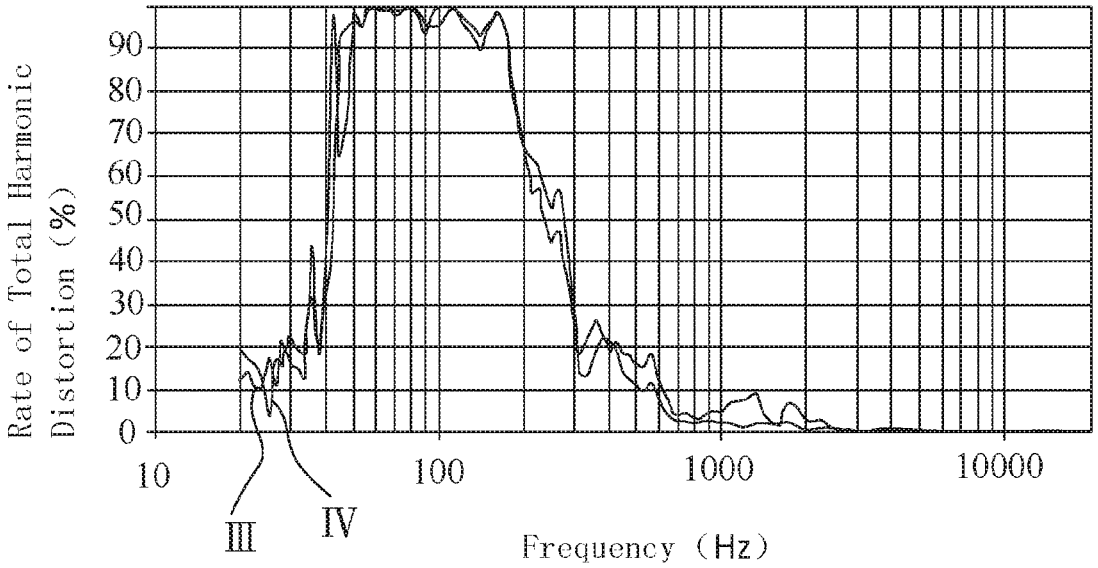
FIG. 5 is a diagram showing the total harmonic distortion rate of the speaker with the vibrating diaphragm of FIG. 1 and the speaker with the vibrating diaphragm with paper material in the related art.

Referring to FIG. 5, which shows the total harmonic distortion rate of the speaker with the vibrating diaphragm 100 and the speaker with the vibrating diaphragm with paper material, a curve III shows the total harmonic distortion rate of the speaker of the vibrating diaphragm with paper material and a curve IV shows the total harmonic distortion rate of the speaker with the vibrating diaphragm 100, the curve III and the curve IV are almost no difference.

As described above, the diaphragm body 10 of the vibrating diaphragm 100 is made by ABS materials, the surface of the diaphragm body 10 is electroplated a layer of nanoscale materials, and the room temperature vulcanization silicone rubber is molded on the outer periphery of the diaphragm body 10 to form the suspended edge 20 to make sure the centers of the diaphragm body 10 and the suspension edge 20 are the same, which improves the high frequency effect of the speaker with the vibrating diaphragm 100.

What is claimed is:

1. A method of manufacturing a vibrating diaphragm, comprising: step one: molding a circular-shaped diaphragm body using acrylonitrile butadiene styrene materials; step two: electroplating a layer of nanoscale materials to a surface of the diaphragm body; step three: placing the diaphragm body in a mold, and molding a room temperature vulcanization silicone rubber on an outer periphery of the diaphragm body to form an annular-shaped suspended edge, an inner periphery of the suspension edge having an annular-shaped slot, an outer periphery of the diaphragm body fixed in the slot of the suspension edge, and the centers of the diaphragm body and the suspension edge being the same.

* * * * *